US009773630B2

(12) United States Patent
Jang

(10) Patent No.: US 9,773,630 B2
(45) Date of Patent: Sep. 26, 2017

(54) APPARATUS FOR REMOTELY OPERATING HANDLE OF CIRCUIT BREAKER

(71) Applicant: LSIS CO., LTD., Anyang-si, Gyeonggi-do (KR)

(72) Inventor: Jun Yong Jang, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 9 days.

(21) Appl. No.: 14/954,842

(22) Filed: Nov. 30, 2015

(65) Prior Publication Data

US 2016/0163490 A1 Jun. 9, 2016

(30) Foreign Application Priority Data

Dec. 3, 2014 (KR) ..... 10-2014-0172430

(51) Int. Cl.
*H01H 71/52* (2006.01)
*H01H 9/22* (2006.01)
*H01H 73/24* (2006.01)

(52) U.S. Cl.
CPC ..... *H01H 71/521* (2013.01); *H01H 9/22* (2013.01); *H01H 73/24* (2013.01)

(58) Field of Classification Search
CPC ..... H01H 9/22; H01H 73/24; H01H 71/521
USPC ..... 200/330, 335, 337, 50.05, 50.06, 50.12, 200/50.15
See application file for complete search history.

(56) References Cited

U.S. PATENT DOCUMENTS 3,272,953 A 9/1966 Tillson
3,629,536 A 12/1971 Rys et al.
3,768,321 A 10/1973 Cox
3,777,084 A * 12/1973 Rys ..... H01H 9/22 200/50.12
3,879,589 A * 4/1975 Rys ..... H01H 9/22 200/50.03

(Continued)

FOREIGN PATENT DOCUMENTS

JP 9-130928 5/1997
KR 20-0469030 9/2013
KR 20-2014-0001706 3/2014

OTHER PUBLICATIONS

European Patent Office Application Serial No. 15196644.7, Search Report dated Apr. 12, 2016, 8 pages.

(Continued)

*Primary Examiner* — Edwin A. Leon
(74) *Attorney, Agent, or Firm* — Lee, Hong, Degerman, Kang & Waimey PC

(57) ABSTRACT

An apparatus for remotely operating a handle of a circuit breaker which includes a handle, a first plate, to which the handle is rotatably connected, allowing the handle to be attached to a distributing board, a second plate allowing the first plate to be attached to the distributing board, a first link transferring a rotary motion of the handle, as a linear motion, and a second link rotated according to the linear motion of the first link to provide rotational force enabling the circuit breaker to be switched on or off, includes a handle operating member connected to the second link, having an elastic member to provide elastic force to the second link, while being rotated cooperatively according to rotation of the second link, to fixedly support an ON or OFF position of the handle.

8 Claims, 7 Drawing Sheets

(56) References Cited

U.S. PATENT DOCUMENTS 4,168,417 A * 9/1979 Puetz ..... H01H 3/46
200/329

OTHER PUBLICATIONS

Korean Intellectual Property Office Application Serial No. 10-2014-0172430, Notice of Allowance dated Feb. 18, 2016, 5 pages.

* cited by examiner

APPARATUS FOR REMOTELY OPERATING HANDLE OF CIRCUIT BREAKER

CROSS-REFERENCE TO RELATED APPLICATION

Pursuant to 35 U.S.C. §119(a), this application claims the benefit of earlier filing date and right of priority to Korean Patent Application No. 10-2014-0172430, filed on Dec. 3, 2014, the contents of which is incorporated by reference herein in its entirety.

BACKGROUND OF THE INVENTION

1. Field of the Invention

The present disclosure relates to an apparatus for remotely operating a handle of a circuit breaker, and particularly, to an apparatus for remotely operating a handle of a circuit breaker, capable of stably fixing a movement position of a handle for adjusting ON or OFF of a circuit breaker and enhancing convenience in installing a handle operating member.

2. Background of the Invention

In general, a circuit breaker is a safety device for protecting an electric wire, switching a load, or breaking an electric line when an overload or a short-circuit accident occurs.

The circuit breaker has a function of switching (ON/OFF) a load to cut off an electric line when a fault current such as an overload or a short-circuit occurs, and here, switching a load is performed through a mechanical operation.

A load switching operation of the circuit breaker is generally performed by a user through a simple operation (pushing or pulling) of a handle exposed to outside of a case, and a load switching mechanism (hereinafter, referred to as a "mechanism") within the circuit breaker is configured to interwork with the handle.

The mechanism itself is complicatedly configured to include various components, and the reason why the mechanism is not simply implemented is because the MCCB has an additional function for quickly opening the circuit breaker when a fault current occurs, rather than simply performing an ON/OFF operation.

That is, the MCCB employs a mechanism of a 2-bar link or 3-bar link structure.

In the MCCB, a breaker body is installed in an internal space of a case, and a handle assembly including a handle and controlling an ON/OFF operation of the breaker body is installed to be exposed to the outside of the case.

The handle assembly is configured such that when a door of the case is closed, the handle assembly may perform an ON operation and an OFF operation of the breaker, but when the door of the case is opened, the handle assembly cannot perform an ON operation of the breaker in order to prevent an accident.

FIG. 1 a view schematically illustrating a circuit breaker including a handle.

As illustrated in FIG. 1, the related art circuit breaker includes a handle 1 rotated according to user manipulation, a first plate 2, to which the handle 1 is rotatably connected, allowing the handle 1 to be attached to a distributing board, a second plate 3 allowing the first plate 2 to be attached to the distributing board, a first link 4 transferring a rotary motion of the handle 1 as a linear motion, a second link 5 rotated according to the linear motion of the first link 4 to provide rotational force enabling the circuit breaker to be switched on or off, a shaft 6 attached to the second plate 3 on the basis of a rotational shaft of the second link 5, and a fastening member 7 connecting the first link 4 and the second link 5.

FIG. 2 is a view schematically illustrating a configuration in which the handle of the circuit breaker is in an OFF state, FIG. 3 is a view schematically illustrating a configuration in which the handle of the circuit breaker is in an ON state, FIG. 4 is a view schematically illustrating a configuration in which a spring is connected when the handle of the circuit breaker is in an OFF state, and FIG. 5 is a view schematically illustrating a configuration in which a spring is connected when the handle of the circuit breaker is in an ON state.

As illustrated in FIGS. 2 through 5, when the user operates the handle to move from an OFF position to an ON position, a connection portion C1 between the first link 4 and the second link 5 is moved to C1'.

Here, when a stroke distance is L1, a rotary motion of the handle 1 is changed into a linear motion to generate stroke L1.

Also, stroke L4 is generated to move C2 to C2' according to a ratio (L2: L3) of a length of a portion and a length of another portion of the second link 5 to generate stroke transmitted to the circuit breaker, and here, a stroke ratio L1:L4 is formed according to L2: L3.

In the circuit breaker operated through the foregoing process, the handle 1 sags down, rather than being fixed to a position of the ON and OFF state, and thus, in order to fix the handle 1 to an appropriate position, a spring 8 is positioned between the first link 4 and the second plate 3.

However, in the circuit breaker in which the spring 8 is installed in the foregoing position, when the first link 4 receives elastic force of the spring 8 in the OFF state, the handle 1 is lifted upwardly by a predetermined distance, causing a problem in which the position in the OFF state is not maintained, and as the elastic force of the spring 8 is increased, it is more difficult to operate the handle 1 to the OFF position.

In addition, when the spring 8 is installed, both ends of the spring 8 should be inserted into the first link 4 and the second plate 3, making it difficult to install the spring 8 to an accurate position.

SUMMARY OF THE INVENTION

Therefore, an aspect of the detailed description is to provide an apparatus for remotely operating a handle of a circuit breaker, capable of stably fixing a movement position of a handle for adjusting ON or OFF of a circuit breaker and enhancing convenience of installation.

To achieve these and other advantages and in accordance with the purpose of this specification, as embodied and broadly described herein, an apparatus for remotely operating a handle of a circuit breaker which includes a handle, a first plate, to which the handle is rotatably connected, allowing the handle to be attached to a distributing board, a second plate allowing the first plate to be attached to the distributing board, a first link transferring a rotary motion of the handle, as a linear motion, and a second link rotated according to the linear motion of the first link to provide rotational force enabling the circuit breaker to be switched on or off, includes: a handle operating member connected to the second link, having an elastic member to provide elastic force to the second link, while being rotated cooperatively according to rotation of the second link, to fixedly support an ON or OFF position of the handle.

The handle operating member may include a body part into which the elastic member is inserted; a rotary member connected to one side of the body part such that the body part movable according to rotation of the second link, and rotatably connected to the second plate; and a fixing member having one side connected to the body part and the other side to which the second link is rotatably connected, to thus receive elastic force through the elastic member.

The rotary member may include a bottom plate having an insertion hole into which the body part is movably inserted, and a side plate bent and extending from the bottom plate so as to be rotatably connected to the second plate.

A stoppage plate may be formed above the second link, a hole may be formed in the stoppage plate, and the fixing member may include a through plate having a through hole into which the body part is inserted, side support plates bent to extend from both ends of the through plate and having a fastening hole allowing a fastening member to penetrate therethrough, and a space part formed between the side support plates and allowing the stoppage plate to be inserted therein, and in a state in which the stoppage plate is inserted into the space part, the fastening member penetrates through the hole and the space part, whereby the second link may be rotatably connected to the fixing member.

When the handle is moved to the ON position, the handle operating member may be upwardly rotated at a predetermined angle according to rotation of the second link to provide an elastic force to the fixing member through the elastic member to provide a rotational force to the second link, and when the handle is moved to the OFF position, the handle operating member may be downwardly rotated at a predetermined angle according to rotation of the second link to provide an elastic fore to the fixing member through the elastic member to provide a rotational force to the second link.

When the handle is moved to the ON position, the second link may receive rotational force to be rotated in a clockwise direction through the elastic member, and when the handle is moved to the OFF position, the second link may receive rotational force to be rotated in a counterclockwise direction through the elastic member.

A fixing protrusion may be formed on an outer surface of each of the side support plates to fixedly support the fastening member.

A ring member may be provided on one side of the body part and positioned between the bottom plate and the body part to prevent release of the body part.

A screw may be formed on an inner side of the through hole and on an outer circumferential surface of the other side of the body part, and a length of the body part is adjusted as the body part is screw-coupled to the through hole.

As described above, in the apparatus for remotely operating a handle of a circuit breaker according to an embodiment of the present disclosure, when the handle is moved to an ON or OFF position, the handle receives rotational force in the same direction as the movement direction through the handle operating member, whereby the handle may be stably maintained in the ON or OFF position, without being moved in the ON or OFF position.

Also, since the handle receives rotational force in the same direction as the direction in which the handle is rotated through the handle operating member, the handle may be smoothly moved.

Also, when the handle operating member is installed in a circuit breaker, the handle operating member is installed in a previously assembled state, and thus, convenience of assembly may be enhanced.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

An apparatus for remotely operating a handle of a circuit breaker according to an embodiment of the present disclosure will be described in detail.

Figure 1:
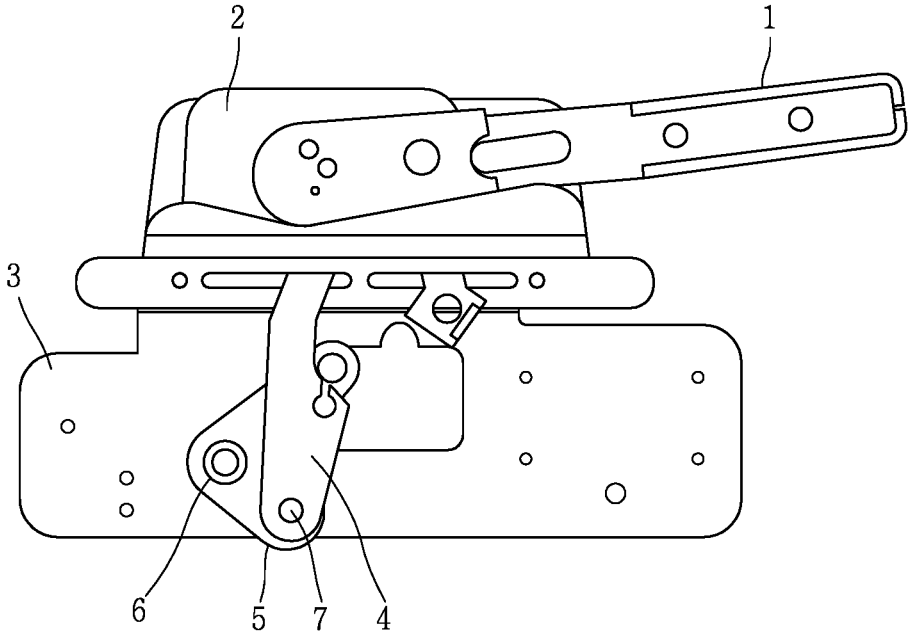
FIG. 1 RELATED ART
FIG. 1 is a view schematically illustrating a state in which a handle is provided in a circuit breaker.
Figure 2:
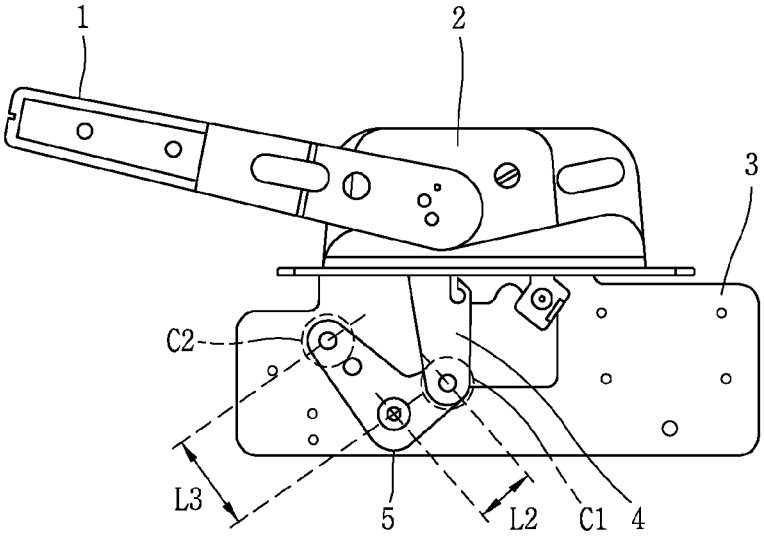
FIG. 2 RELATED ART
FIG. 2 is a view schematically illustrating a state in which a handle of a circuit breaker is in an OFF state.
Figure 3:
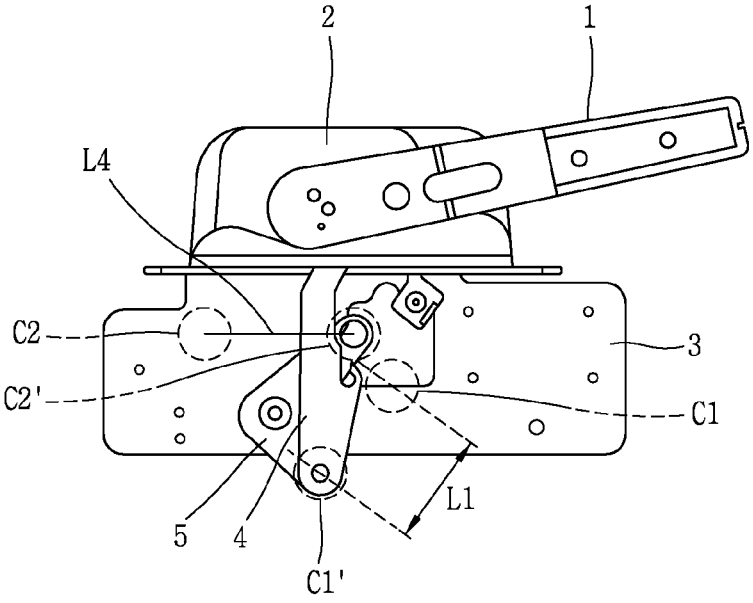
FIG. 3 RELATED ART
FIG. 3 is a view schematically illustrating a state in which a handle of a circuit breaker is in an ON state.
Figure 4:
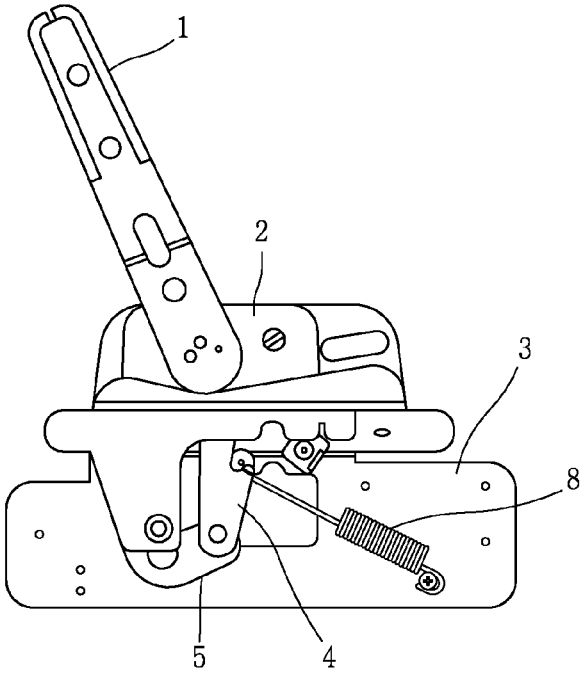
FIG. 4 RELATED ART
FIG. 4 is a view schematically illustrating a state in which a spring is installed when a handle operating unit of a circuit breaker is in an OFF state.
Figure 5:
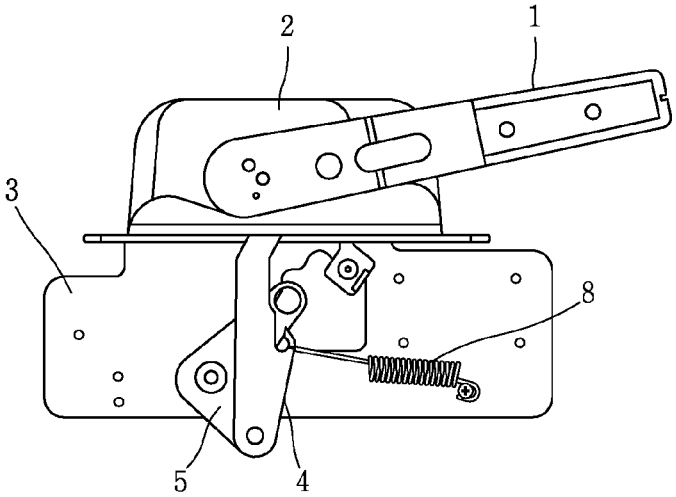
FIG. 5 RELATED ART
FIG. 5 is a view schematically illustrating a state in which a spring is installed when a handle operating unit of a circuit breaker is in an ON state.
Figure 6:
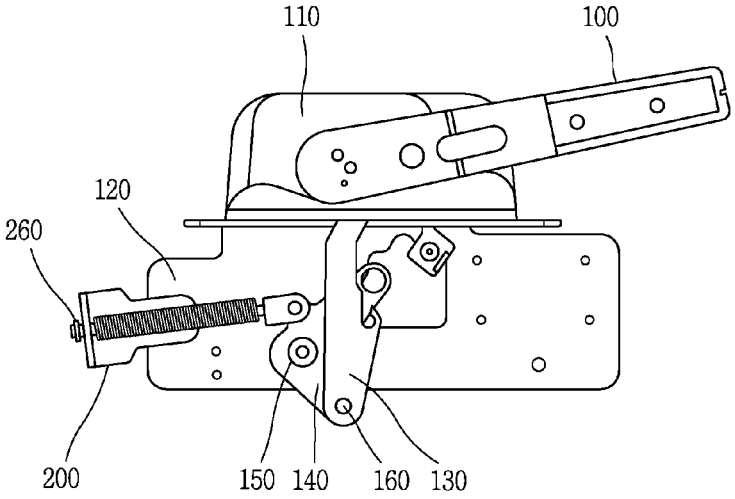
FIG. 6 is a view schematically illustrating a state in which a handle operating member according to an embodiment of the present disclosure is provided in a circuit breaker.

FIG. 6 is a view schematically illustrating a state in which a handle operating member according to an embodiment of the present disclosure is provided in a circuit breaker, FIG.

Figure 8:
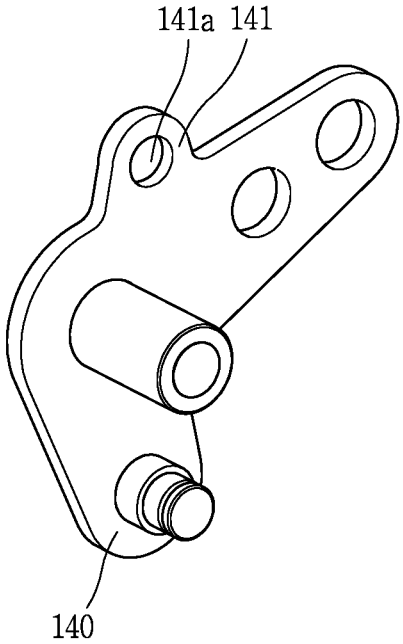
FIG. 8 is a perspective view illustrating a second link according to an embodiment of the present disclosure.
Figure 9:
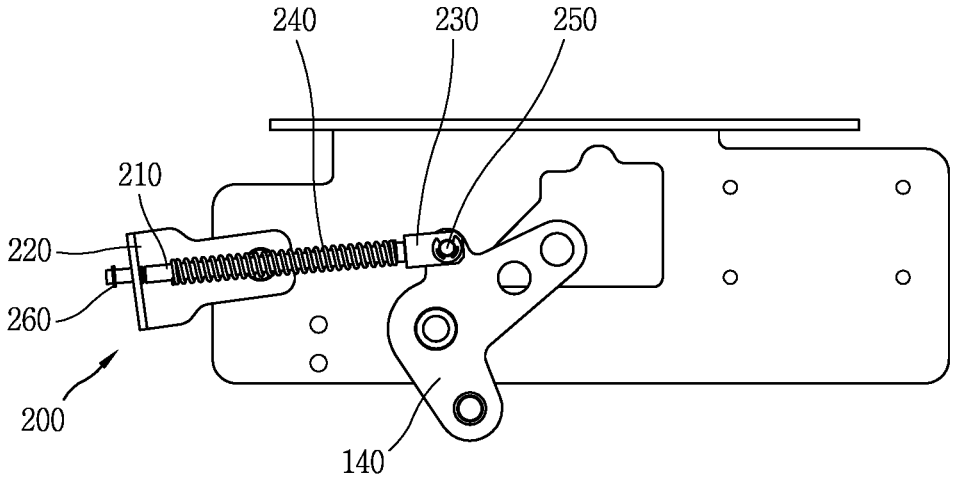
FIG. 9 is a side view illustrating a state in which a handle operating member according to an embodiment of the present disclosure is connected to a second link.

7 is a perspective view illustrating a handle operating member according to an embodiment of the present disclosure, FIG. 8 is a perspective view illustrating a second link according to an embodiment of the present disclosure, and FIG. 9 is a side view illustrating a state in which a handle operating member according to an embodiment of the present disclosure is connected to a second link.

Figure 10:
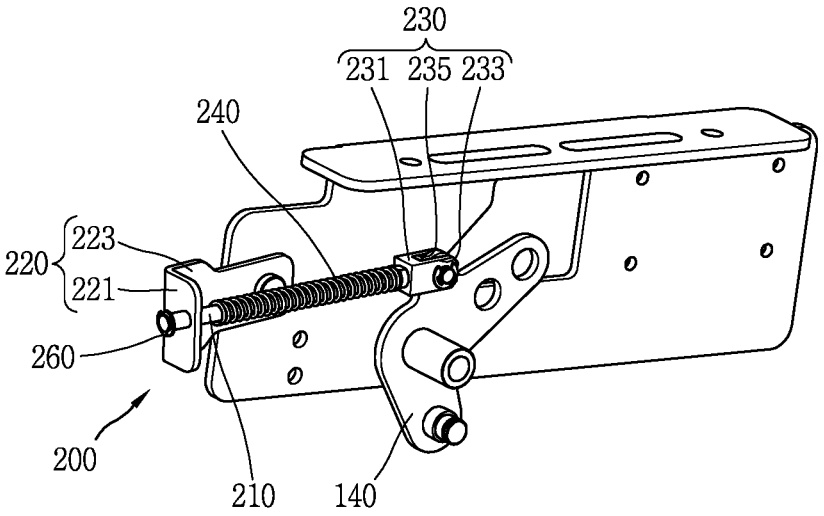
FIG. 10 is a perspective view illustrating a state in which a handle operating member according to an embodiment of the present disclosure is connected to a second link.
Figure 11:
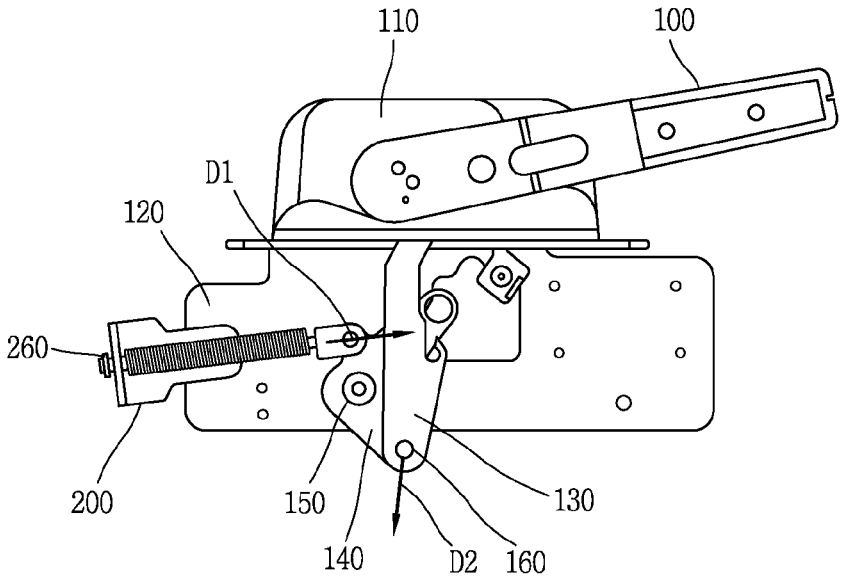
FIG. 11 is a view schematically illustrating a state in which a handle operating member in an ON state according to an embodiment of the present disclosure is provided within a circuit breaker.
Figure 12:
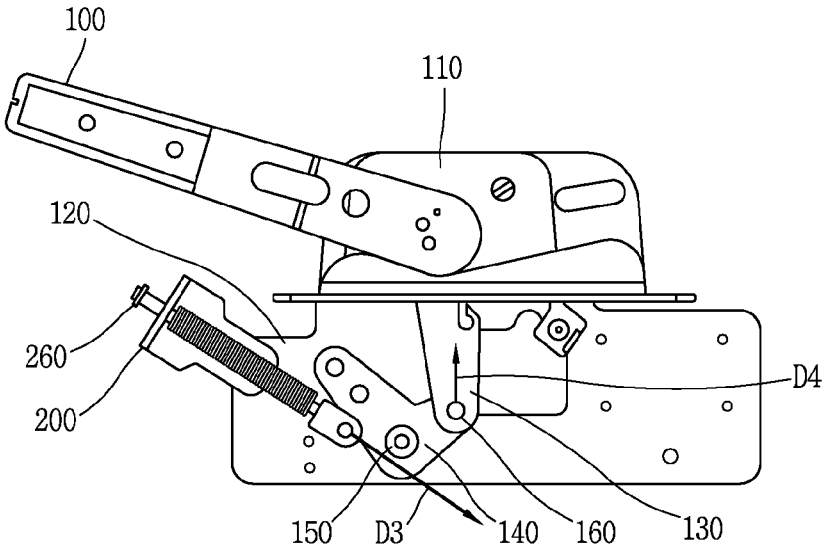
FIG. 12 is a view schematically illustrating a state in which a handle operating member in an OFF state according to an embodiment of the present disclosure is provided within a circuit breaker.

FIG. 10 is a perspective view illustrating a state in which a handle operating member according to an embodiment of the present disclosure is connected to a second link, FIG. 11 is a view schematically illustrating a state in which a handle operating member in an ON state according to an embodiment of the present disclosure is provided within a circuit breaker, and FIG. 12 is a view schematically illustrating a state in which a handle operating member in an OFF state according to an embodiment of the present disclosure is provided within a circuit breaker.

As illustrated in FIG. 6, a circuit breaker according to an embodiment of the present disclosure includes a handle 100 rotated to an ON or OFF position according to a user manipulation, a first plate 110, to which the handle 100 is rotatably connected, allowing the handle 100 to be attached to a distributing board, a second plate 120 allowing the first plate 110 to be attached to the distributing board, a first link 130 transferring a rotary motion of the handle 100 as a linear motion, a second link 140 rotated according to the linear motion of the first link 130 to provide rotational force enabling the circuit breaker to be switched on or off, a shaft 150 attached to the second plate 120 on the basis of a rotational shaft of the second link 140, a fastening member 160 connecting the first link 130 and the second link 140, and an apparatus for remotely operating a handle for fixing a movement position of the handle 100.

Here, the apparatus for remotely operating a handle includes a handle operating member 200. One side of the handle operating member 200 is connected to the second link 140, and an elastic member 240 such as a spring is provided. The handle operating member 200 is rotated according to rotation of the second link 140 to provide elastic force to the second link 140 through the elastic member 240 to fixedly support an ON or OFF position of the handle 100.

Figure 7:
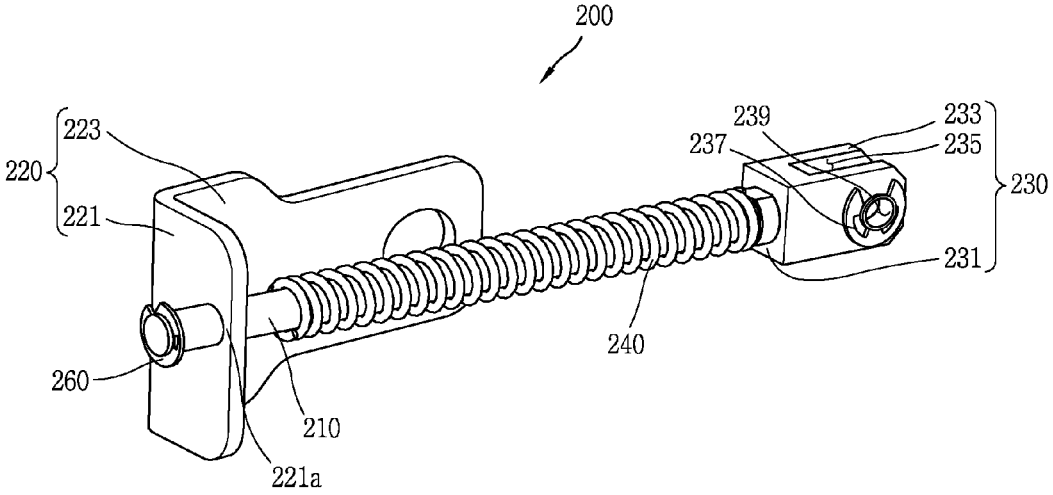
FIG. 7 is a perspective view illustrating a handle operating member according to an embodiment of the present disclosure.

As illustrated in FIG. 7, the handle operating member 200 includes a body part 210, a rotary member 220, and a fixing member 230.

The body part 210 has a cylindrical shape, and the elastic member 240 such as a spring, or the like, providing elastic force is inserted into the body part 210.

The rotary member 220 is connected to one side of the body part 210 such that the body part 210 is movable, and rotatably connected to the second plate 120 and rotated cooperatively within a distributing board according to rotation of the handle 100.

Here, the rotary member 220 includes a bottom plate 221 having an insertion hole 221*a* to which one side of the body part 210 is movably inserted, and a side plate 223 bent and extending from the bottom plate 221 so as to be rotatably connected to the second plate 220. The rotary member 220 is connected to the body part 210 through the bottom plate 221 and rotatably connected to the second plate 120 through the side plate 223.

One side of the fixing member 230 is connected to the body part 210, and the second link 140 is rotatably connected to the other side of the fixing member 230, so that the fixing member 230 moves together with the body part 210, upon receiving elastic force through the elastic member 240, to rotate the second link 140 at a predetermined angle.

Here, the fixing member 230 includes a through plate 231 having a through hole (not shown) to which the body part 210 is inserted, side support plates 233 bent to extend from both ends of the through plate 231 and having a fastening hole 239 allowing a fastening member 250 (please refer to FIG. 10) to penetrate therethrough, and a space part 235 formed between the side support plates 233 and allowing the second link 140 to be inserted therein.

As illustrated in FIG. 8, a stoppage plate 141 is formed above the second link 140, and a hole 141*a* is formed in the stoppage plate 141.

Thus, as illustrated in FIGS. 9 and 10, in a state in which the stoppage plate 141 is inserted into the space part 235, as the fastening member 250 penetrates through the hole 141*a*, the fastening hole 239, and the space part 235 formed at the side support plates 233, the second link 140 is rotatably connected to the fixing member 230, and upon receiving elastic force in a direction of the second link 140 through the elastic member 240 such as a spring provided in the body part 210, the body part 210 and the fixing member 230 are moved toward the second link 140 to push the second link 140 such that the second link 140 receives rotational force in a clockwise or counterclockwise direction.

Here, a fixing protrusion 237 fixedly supporting the fastening member 250 is formed on an outer surface of the side support plate 233, and the fixing member 230 and the second link 140 are firmly connected by the fastening member 250 through the fixing protrusion 237.

Also, a ring member 260 is provided at one side of the body part 210 and positioned between the body part 210 and the bottom plate 221 to prevent the body part 210 from being released.

A screw is formed at an inner side of the through hole and on an outer circumferential surface of the other side of the body part 210 such that the body part 210 is fastened to the through hole through screw coupling, whereby a length of the body part 210 between the bottom plate 221 and the fixing member 230 is adjusted to adjust an elastic force of the elastic member 240.

Hereinafter, a process of operating the apparatus for remotely operating a handle of the circuit breaker according to an embodiment of the present disclosure will be described in detail with reference to the accompanying drawings.

First, as illustrated in FIG. 11, when the handle 100 moves to an ON position according to user manipulation, the first link 130 makes a linear motion cooperatively according to the movement of the handle to be moved downwardly, and as the first link 130 is moved downwardly, the second link 140 connected to the first link 130 is also rotated in a clockwise direction cooperatively according to the linear motion of the first link 130.

Here, when the handle 100 is moved to the ON position, the elastic member 240 of the handle operating member 200 pushes the fixing member 230 and the fixing member 230 is moved together with the body part 210 to provide an elastic force in a D1 direction, thereby providing rotational force enabling the second link 140 to be rotated in the clockwise direction.

Thus, the first link 130 connected to the second link 140 receives a force downwardly (D2) due to the rotational force exerted on the second link 140 to be rotated in the clockwise direction, whereby the handle 100 may be stably and firmly maintained in the ON position without being moved.

Thereafter, when the user rotates the handle 100 to an OFF position, the first link 130 is moved upwardly according to the rotation of the handle 100 and the second link 140 is rotated in a counterclockwise direction accordingly.

Here, a length of the handle operating member 200 is adjusted as the fixing member 230 and the body part 210 connected to the fixing member 230 are moved through the insertion hole 221*a* formed on the bottom plate 221 according to the rotation of the second link 140, and when the handle 100 is in the OFF position, the fixing member 230 pushes the second link 140 though elastic force of the elastic member 240 to provide an elastic force in a D3 direction to provide rotational force enabling the second link to be rotated in a counterclockwise direction.

When the second link 140 receives the rotational force exerted on the second link 140 to be rotated in the counterclockwise direction, the first link 130 connected to the second link 140 receives force (D4) upwardly, and thus, the handle 100 is maintained in the OFF position, without being moved.

In the present disclosure described above, when the handle 100 is moved to the position of the ON or OFF state, an elastic force is provided to the second link 140 through the handle operating member 200 such that the handle 100 receives rotational force in the same direction as the movement direction of the handle 100, whereby the handle 100 may be stably maintained in the ON or OFF position without being moved.

Also, since the handle 100 receives rotational force in the same direction as the rotation direction of the handle 100 through the handle operating member 200, the handle 100 may be smoothly moved.

When the handle operating member 200 is installed in the circuit breaker, the handle operating member 200 may be installed in an assembled state, thus enhancing convenience of assembling.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for remotely operating a handle of a circuit breaker, the apparatus comprising:

a handle;

a first plate, to which the handle is rotatably connected, allowing the handle to be attached to a distributing board;

a second plate allowing the first plate to be attached to the distributing board;

a first link transferring a rotary motion of the handle, as a linear motion;

a second link rotated according to the linear motion of the first link to provide rotational force enabling the circuit breaker to be switched on or off; and a handle operating member connected to the second link, having an elastic member to provide elastic force to the second link, while being rotated cooperatively according to rotation of the second link, to fixedly support an ON or OFF position of the handle, wherein the handle operating member includes a body part into which the elastic member is inserted; a rotary member connected to one side of the body part such that the body part movable according to rotation of the second link, and rotatably connected to the second plate; and a fixing member having one side connected to the body part and the other side to which the second link is rotatably connected, to thus receive elastic force through the elastic member.

2. The apparatus of claim 1, wherein the rotary member includes a bottom plate having an insertion hole into which the body part is movably inserted, and a side plate bent and extending from the bottom plate so as to be rotatably connected to the second plate.

3. The apparatus of claim 1, wherein a stoppage plate is formed above the second link, a hole is formed in the stoppage plate, and the fixing member includes a through plate having a through hole into which the body part is inserted, side support plates bent to extend from both ends of the through plate and having a fastening hole allowing a fastening member to penetrate therethrough, and a space part formed between the side support plates and allowing the stoppage plate to be inserted therein, and in a state in which the stoppage plate is inserted into the space part, the fastening member penetrates through the hole and the space part, whereby the second link is rotatably connected to the fixing member.

4. The apparatus of claim 1, wherein when the handle is moved to the ON position, the handle operating member is upwardly rotated at a predetermined angle according to rotation of the second link to provide an elastic force to the fixing member through the elastic member to provide a rotational force to the second link, and when the handle is moved to the OFF position, the handle operating member is downwardly rotated at a predetermined angle according to rotation of the second link to provide an elastic fore to the fixing member through the elastic member to provide a rotational force to the second link.

5. The apparatus of claim 4, wherein when the handle is moved to the ON position, the second link receives rotational force to be rotated in a clockwise direction through the elastic member, and when the handle is moved to the OFF position, the second link receives rotational force to be rotated in a counterclockwise direction through the elastic member.

6. The apparatus of claim 3, wherein a fixing protrusion is formed on an outer surface of each of the side support plates to fixedly support the fastening member.

7. The apparatus of claim 2, wherein a ring member is provided on one side of the body part and positioned between the bottom plate and the body part to prevent release of the body part.

8. The apparatus of claim 3, wherein a screw is formed on an inner side of the through hole and on an outer circumferential surface of the other side of the body part, and a length of the body part is adjusted as the body part is screw-coupled to the through hole.

* * * * *